US006598238B2

(12) United States Patent
Hong et al.

(10) Patent No.: US 6,598,238 B2
(45) Date of Patent: Jul. 29, 2003

(54) JAW PROTECTING APPARATUS OF HELMET

(75) Inventors: Wan-Ki Hong, Seoul (KR); Kwang-Moon Choi, Suwon (KR); Jin-Gon Lee, Kyunggi-do (KR); Jung-Hwan Park, Yongin (KR)

(73) Assignee: HJC Co., Ltd., Kyunggi-do (KR)

( * ) Notice: Subject to any disclaimer, the term of this patent is extended or adjusted under 35 U.S.C. 154(b) by 0 days.

(21) Appl. No.: 09/729,596

(22) Filed: Dec. 4, 2000

(65) Prior Publication Data

US 2002/0129440 A1 Sep. 19, 2002

(30) Foreign Application Priority Data

Dec. 6, 1999 (KR) ..... 99-55718

(51) Int. Cl.[7] ..... A42B 1/08
(52) U.S. Cl. ..... 2/424
(58) Field of Search ..... 2/424, 425, 9, 2/410, 6.3, 6.4, 6.5, 6.7

(56) References Cited

U.S. PATENT DOCUMENTS

| | | | | |
|---|---|---|---|---|
| 4,397,047 | A | * | 8/1983 | Nava |
| 5,084,918 | A | * | 2/1992 | Breining et al. |
| 5,901,369 | A | * | 5/1999 | Pilney |
| 6,212,689 | B1 | * | 4/2001 | Lee |
| 6,226,803 | B1 | * | 5/2001 | Tanaka |
| 6,249,918 | B1 | * | 6/2001 | Lacroix |

FOREIGN PATENT DOCUMENTS

| | | | |
|---|---|---|---|
| EP | 108694 | * | 5/1984 |

* cited by examiner

*Primary Examiner*—Rodney M. Lindsey
(74) *Attorney, Agent, or Firm*—R. Neil Sudol; Henry D. Coleman; William J. Sapone

(57) ABSTRACT

A motorcycle helmet includes a jaw protector pivotably attached to the helmet along opposite sides thereof. The jaw protector is provided with at least one releasable lock fixing the jaw protector in a lowered use position. The lock is deactivated for enabling a pivoting of the jaw protector to a raised position.

10 Claims, 8 Drawing Sheets

JAW PROTECTING APPARATUS OF HELMET

FIELD OF THE INVENTION

The invention relates to a jaw protecting apparatus of helmet so as to stabilize a feeling of wearing by smoothly moving up and down a jaw protection, which is installed in front of the helmet, and then letting the center of gravity be located in the rear of the helmet, in a helmet which is worn to protect the head of a person taking a motorbicycle.

DESCRIPTION OF THE PRIOR ART

Generally where a person rides on two wheeled vehicles such as motorbicycles, etc . . . , a rider should necessarily wear a helmet for protecting a head, in order to protect his head. Such helmets are made so as to not obstruct the view of people wearing them due to wind force rising in front of him, and to solve respiratory distress.

Meanwhile, conventional helmets installed and used in the same manner as stated above, have jaw protections at their below portions to protect jaws of peoples wearing helmets. This jaw protecting apparatus is made so as to fix the two ends at both sides of the body of the said helmet. A jaw protection fixed at the said helmet, is firmly fixed and installed not to be detached from the helmet.

However, a person wearing the helmet can neither talk with the other party nor drink beverage nor smoke. In addition, the same conventional helmet protections as stated above, was made in order for the fixture, the pivot of the gravity center to be firmly installed at the center of said helmet body on the condition that an antishocking member is equipped in the inside of the outer body.

Therefore, conventional jaw protections of helmets have a defect that a feeling of wearing helmets is very bad since when wearing the said helmet, the loading of said jaw protection is pressed in the front of the person wearing it.

In addition, since the jaw protection of said helmet is fixed on the condition that it is not rotated, when said helmet is put on or taken off, the said jaw protection is being an obstacle and furthermore, has problems, that is to say, it is very inconvenient for a person to wear or take off said helmet.

SUMMARY OF THE INVENTION

The present invention is devised by considering all problems of the same conventional helmets as stated above, and contriving solutions. The purpose of the present invention is to provide a jaw protecting apparatus of helmet which is designed to stabilize a feeling of wearing a helmet, by smoothly moving up and down the jaw protection which is installed in front of the helmet, to protect the jaw of a person wearing the helmet, and by locating the gravity center of said jaw protection at the back of the helmet, in the helmet which is worn to protect the head of the rider when he rides on a motorbicycle. Hereinafter, the detailed descriptions pursuant to the enclosed drawings, will be provided.

Figure 1:
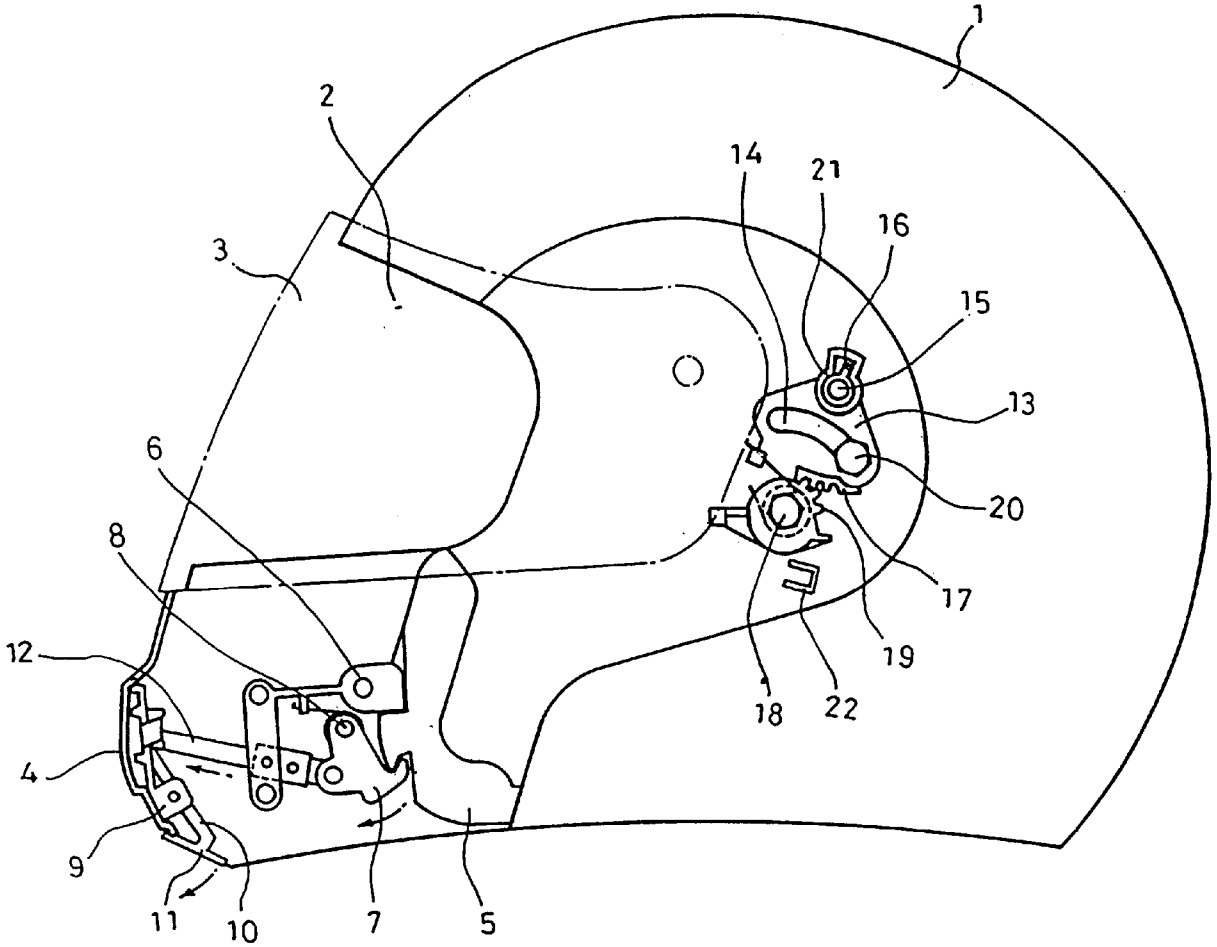
FIG. 1 is a unilateral cross-sectional view showing the installation state of the first embodiment of the present invention.
Figure 2:
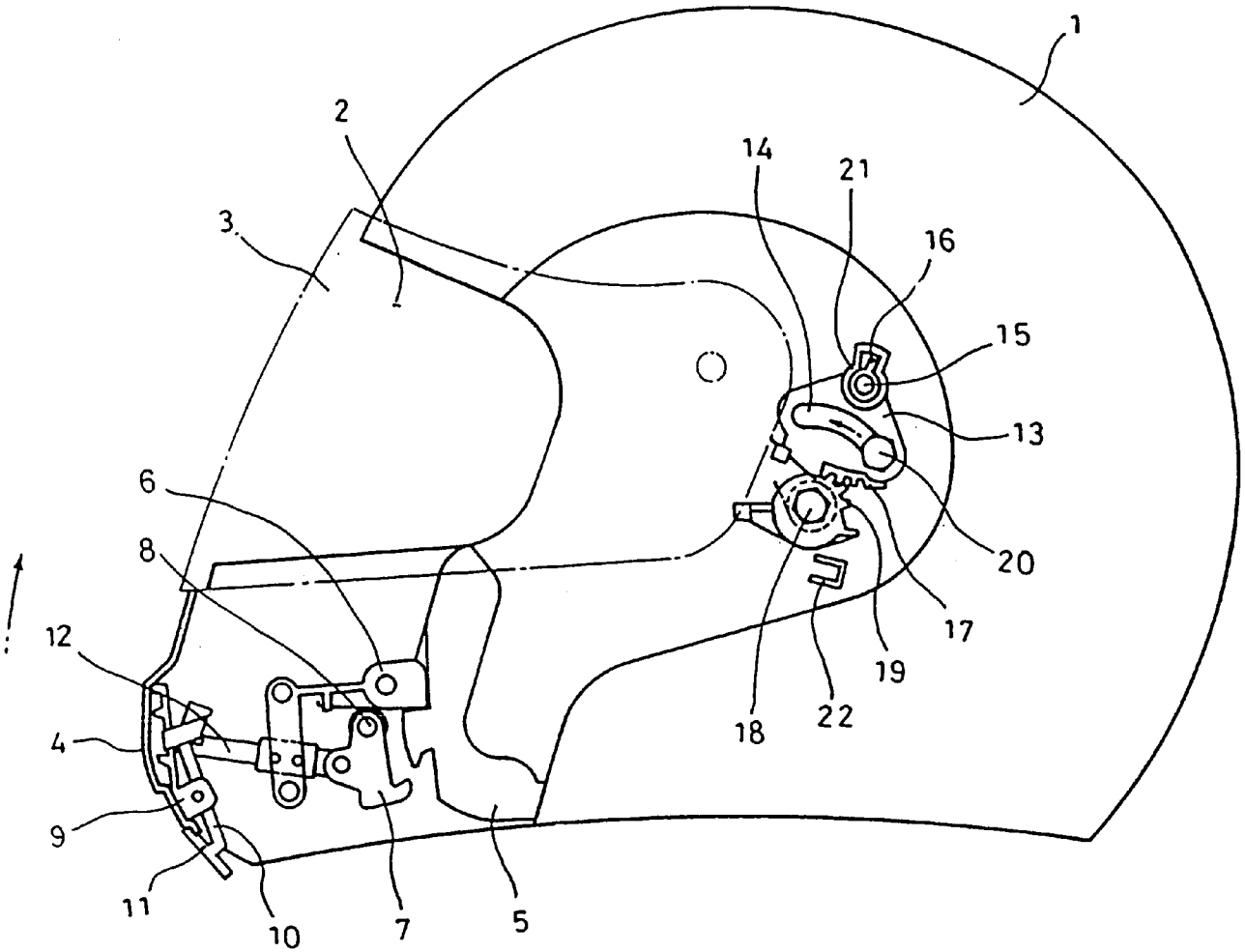
FIG. 2 is a cross-sectional view showing the state of the helmet jaw protection when the helmet jaw protection of the first embodiment of the present invention is fixed.
Figure 3:
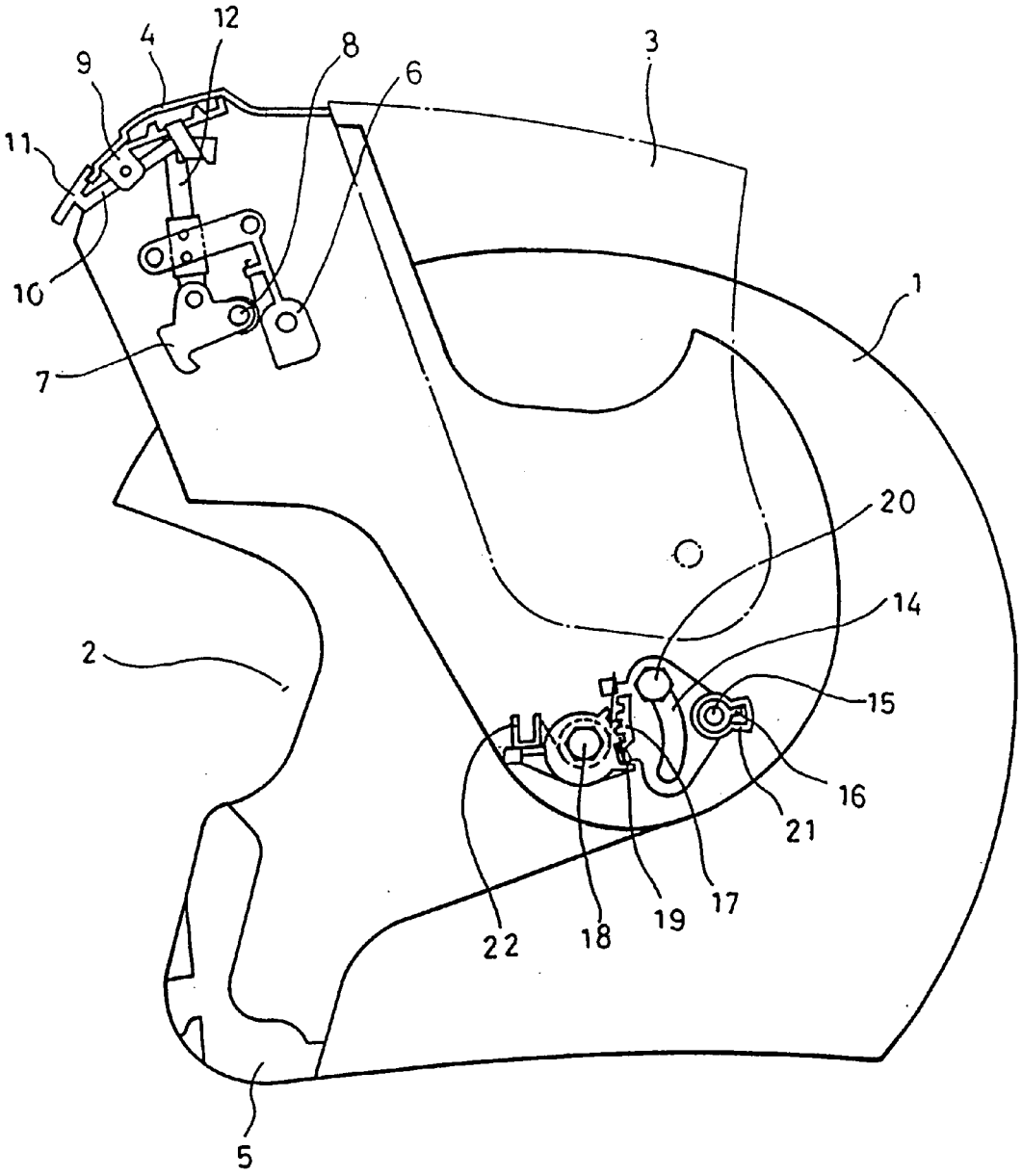
FIG. 3 is a cross-sectional view showing the state where the helmet jaw protection of the first embodiment of the present invention is moved up.
Figure 4:
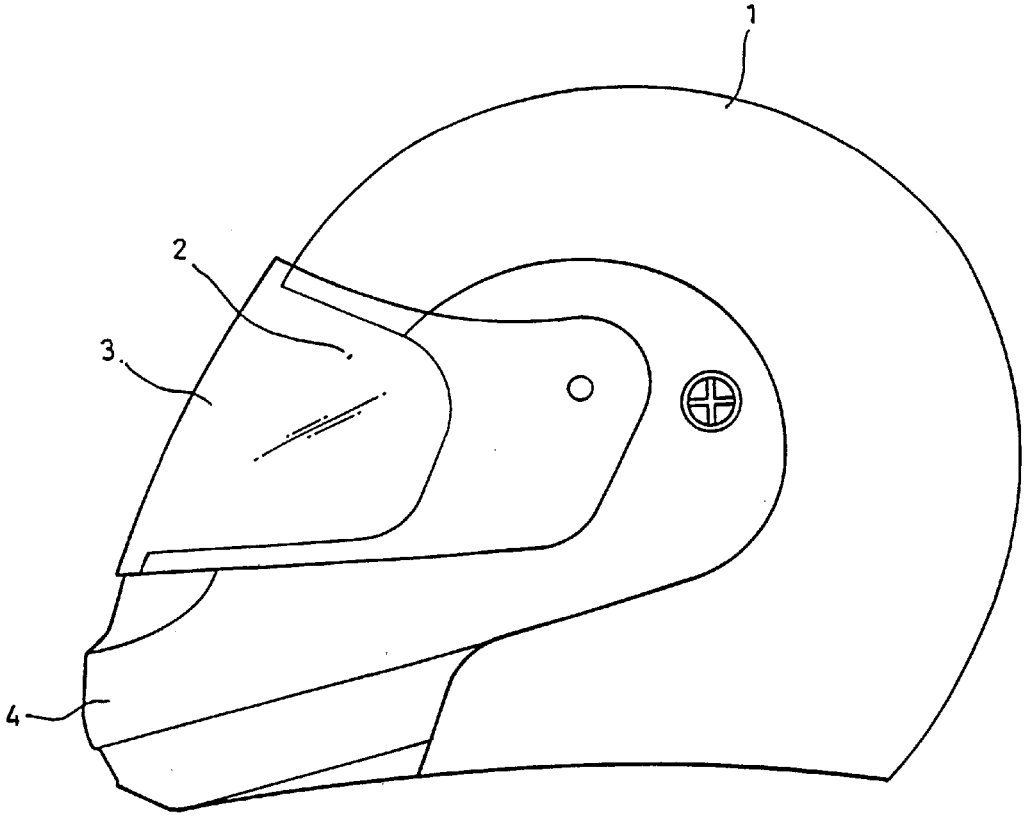
FIG. 4 is a lateral view showing the state where the helmet jaw protection of the first embodiment of the present invention is installed.

<The Explanation of Signs of the Main Portion of Drawings>

| | | | |
|---|---|---|---|
| 1. | Helmet body | 2. | Opening portion |
| 3. | Shield | 4. | Jaw protection |
| 5, 501: | Fixture | 6, 701: | Guide |
| 7, 601: | locker | 8: | shaft |
| 9: | Supporter | 10, 101: | Rotation member |
| 11: | Handle | 12: | Band |
| 13, 131: | Rotary link | 14, 602: | elongated arcuate slot or hole |
| 15: | Rotary central pivot | 16: | Protrusion |
| 17, 171, 19, 191: | Planetary gear | 18: | Fixed pivot |
| 20: | control bolt | 21: | Guider |
| 22, 221: | Stopper | 23: | Spring |
| 24: | Wire guide | 25: | Wire |
| 26: | Bridging | 27: | Extension plate |

DESCRIPTION OF THE PREFERRED EMBODIMENTS

In having installed a shield (3) enabled to move up and down in the front opening portion (2) of a helmet body (1) and a jaw protection (4) equipped with an antishocking member in the front of the lower portion of a shield (3), a fixture (5) having bridgings at both side ends of the said helmet body (1) is installed and a locker (7), which is supported on each of guide (6) at the two-sides of said jaw protection (4), and then turns on the center of pivot (8), is oppositely installed.

A supporter (9) is installed inside of the front of said jaw protecting apparatus (4), and a rotation member wherein a handle (11) is formed thereto, is installed so as to enable to rotate. At said rotation member (10), the central portion of a band (12) connected to said lockers (7), is fixedly install, thereby lockers (7) connected to a band (12) according to the rotation member (10), are rotated. And subsequently, the lockers are locked at said fixture (5), at the time of their rotation.

A rotary link (13) wherein an elongated slot in the form of a circular arc (14) is provided, is installed at the upper portion of the protecting apparatus (4). At this rotary link (13), a rotary central pivot (15) wherein a protrusion is formed and a planetary gear (17) are installed and at a pivot (18) of a central shield (3) of the helmet body (1), a second planetary gear (19) engaging with the first planetary gear (17) is installed. At an upper portion of the pivot (18), a control bolt (20) and a guider (21) are formed respectively, and the control bolt (20) is installed in a manner that it may be inserted into the arcuate slot (14) of the rotary link (13) and that the rotary central pivot (15) may be inserted at the guider (21) and that a stopper (22) may be fixed on the jaw protection assembly at a location below the fixed pivot (18).

Figure 5:
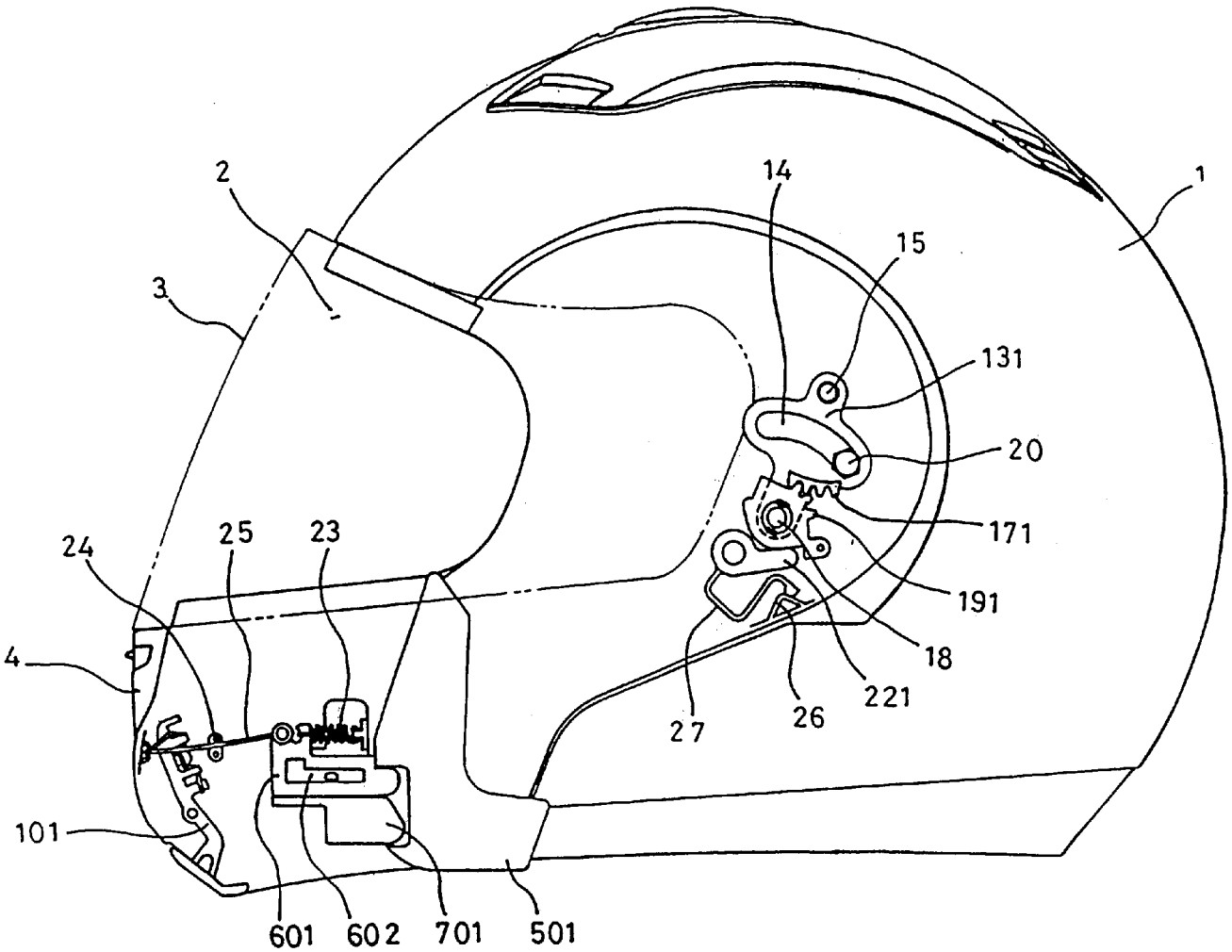
FIG. 5 is a unilateral cross-sectional view showing the state of the installation of the second embodiment of the present invention.
Figure 6:
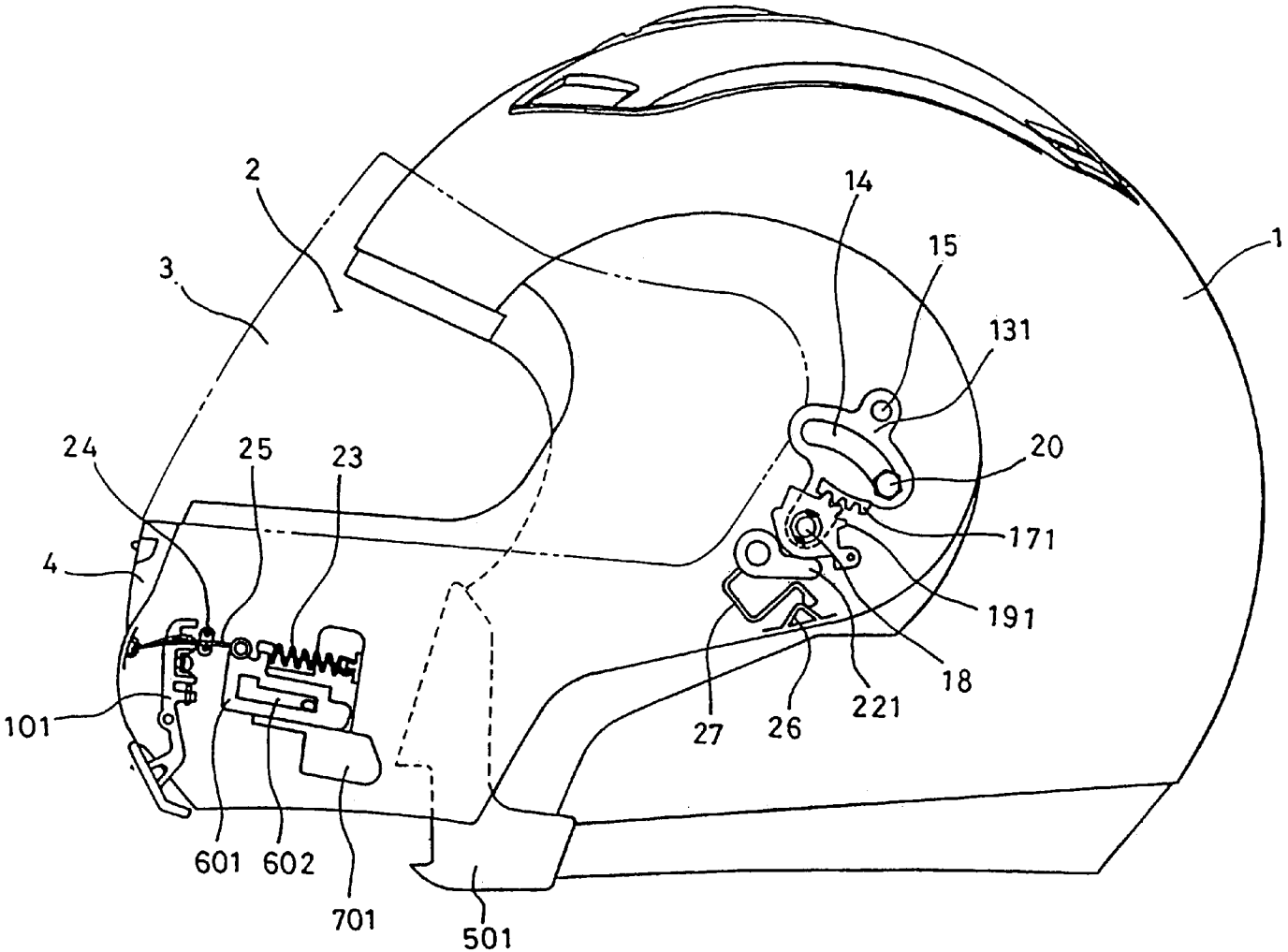
FIG. 6 is a cross-sectional view showing the state where the helmet jaw protection of the second embodiment of the present invention is fixed.
Figure 7:
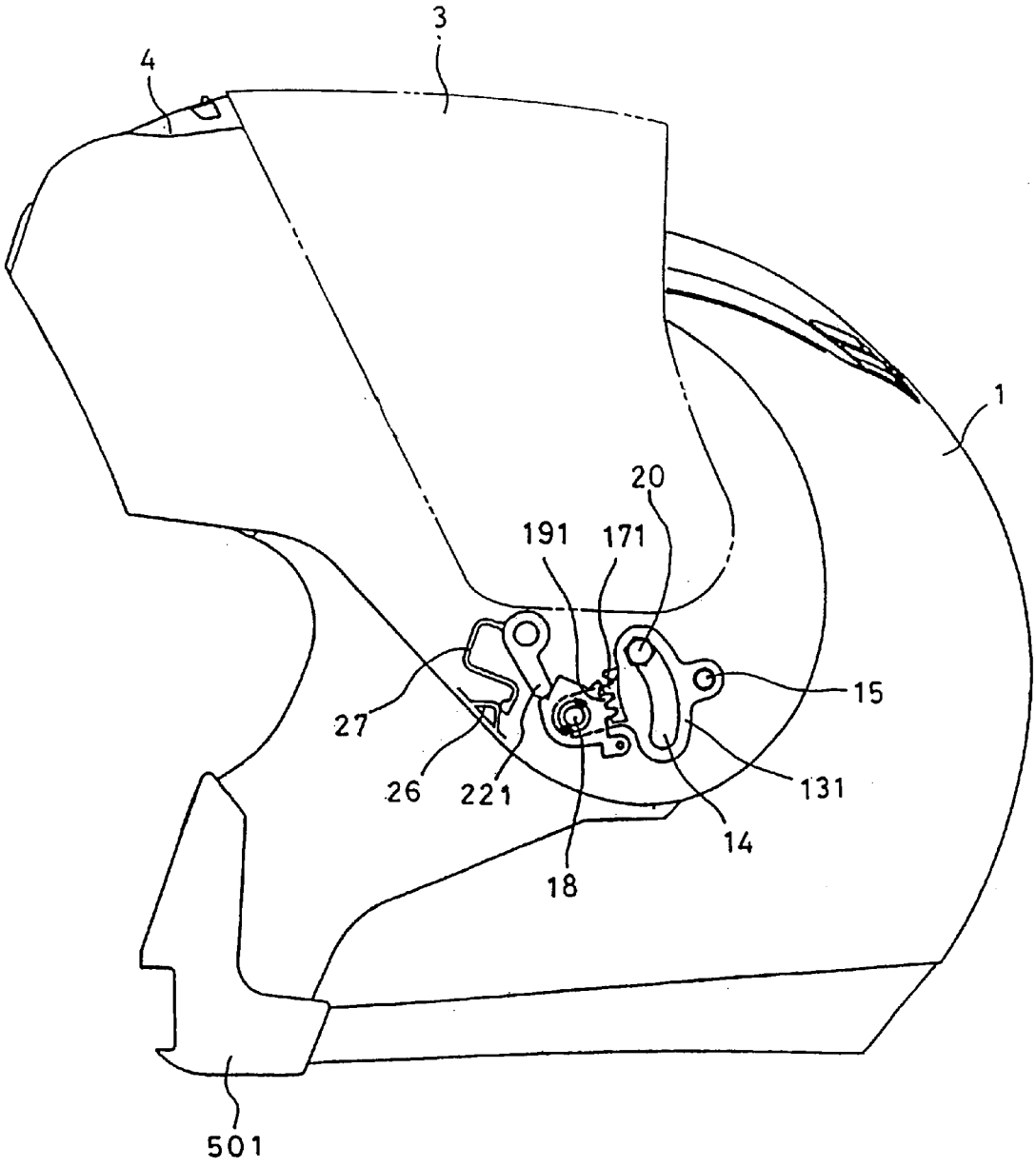
FIG. 7 is a cross-sectional view showing the stated where the helmet jaw protection of the second embodiment of the present invention is moved up.
Figure 8:
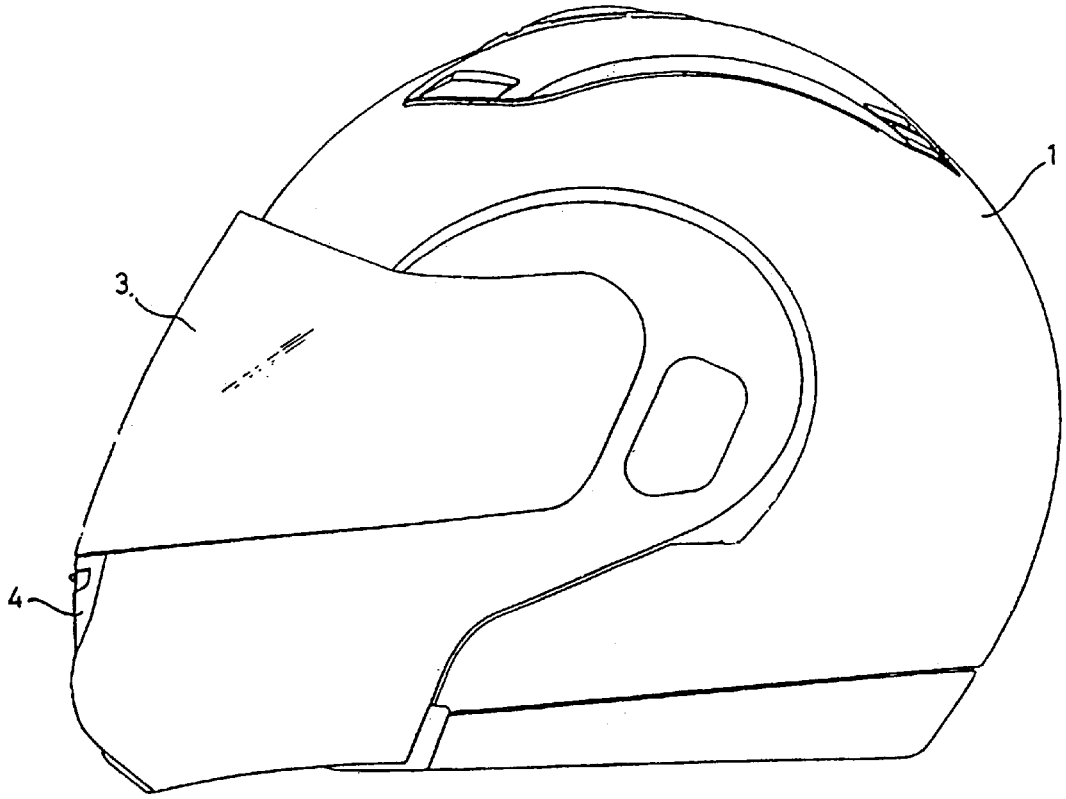
FIG. 8 is a lateral view showing the state where the jaw protection of the second embodiment of the present invention is installed.

In addition, in the one direction of a fixture (501) having a bridging, as in FIG. 5 to FIG. 8, a guide (701) is installed and a locker or locking element (601) which is elastically installed with a spring (23) at this guide (701), is installed in such a manner that it may slide along a guide slot (602) and in a state where the one end of a wire (25) guided by a wire guide (24) at the inner side end of the jaw protection (4), is fixed, this wire (25) is coupled to a rotation member (101), and the other end of the wire (25) is installed by sticking it to the locker (601).

In the rear of said jaw protecting apparatus (4), a rotary link (131) having a planetary gear (171) is installed, and a planetary gear (191) is engaged with said planetary gear (171). In this context, this planetary gear (19) is installed in such a manner that the gear is controlled by a stopper (221) controlled by a bridging (26) and a resilient plate (27).

Hereinafter, we are explaining the status of action of the present invention composed as described above.

In having installed a shield (3), which is movable up and down, at the front opening portion (2) of said helmet body (1) and a jaw protection (4) equipped with an anti-shocking material at the front lower portion of the shield (3), a fixture (5) having bridgings at both side ends of said helmet body (1) is installed and a locker (7) which is supported on each guide (6) at two sides of the said jaw protection (4), and which turns on a axis (8), is oppositely installed. Under the condition that a rotation member (10) wherein a handle (11) is formed at a supporter (9) in the inner front side of said jaw protection (4), and which is allowed to turn, is installed, the central portion of a band (12) connecting to said lockers (7) is fixedly installed. Therefore, according to a rotation of a rotation member (10), lockers (7) connected to a band (12) is rotated. When the lockers are rotated, they are locked at said fixture 5). If a handle (11) of said rotation part (10) is pressed, said rotation member (10) is rotated and at the same time, the band (12) fixed thereto, will become pulled. According as this band (12) is pulled, said locker (7) turns on a shaft (8), and is detached from a fixture (5) The detachment of this locker (7) allows the up movement of said jaw protection (4). If said jaw protection (4), which was moved up, is moved down, said locker (7) will be moved down according to the slant portion of the fixture (5) and at the same time, it is suspended on the fixture (5). Therefore, said jaw protection (4) becomes fixed.

In addition, a rotation link (13) is installed, wherein a rotary central pivot (15) is formed, and wherein a circular arc slot (14) and a protrusion (16) are provided on the upper portion of the jaw protection assembly. At this rotation link (13), a planetary gear (17) is installed and at the same time, it is connected to and installed at a fixed pivot (18). In this context, the planetary gear (17) is installed in order for it to go in gear with a second planetary gear (19) installed at the fixed pivot (18). By doing so, at the time the jaw protection assembly (4) is moved up, the center of rotation of the jaw protection assembly (4) is allowed to be located at the back of the fixed pivot (18). Subsequently, by inserting and installing an arcuate slot (14) and a rotation center pivot (15) of the rotation link (13) at a control bolt (20) and a guider (21), which is fixed to the jaw protection assembly at a location above the fixed pivot (18), the rotation link (13) is allowed to be smoothly rotated. In addition, after the rotation link (13) is opened and rotated, a stopper (22) which is fixed to the jaw protection assembly at a location below the fixed pivot (18), leads to the suppression of reverse rotation. The protrusion (16) of the rotation center pivot (15) inserted and installed at the guider (21), controls the scope of rotation of the rotation link (13).

Additionally, if the invention is realized as embodiments shown in FIGS. 5 to 8, when a person wishes to open a jaw protection assembly or device (4), a rotation member (101) connected to a wire (25) needs to be pulled. In this context, if this rotation member (101) is pulled, wire (25) connected thereto will pull a locker or locking element (601) installed at a guide (701). The locker (601) slides in a slot (602) formed in the guide (701) and is detached from a fixture (501) having said bridging and subsequently, the jaw protection device can be opened.

If said jaw protection (4) is moved down just as it is when said opened jaw protection (4) is closed, said locker (601) is under the resilience of a spring (23) and at the same time, the slant portion formed in one direction, leads to be hung on said fixture (501).

When a jaw protection (4) is opened and closed as stated above, a rotation link (131) having a planetary gear (171) which is installed at the back of said jaw protection (4) rotates according to the replacement and combination of the rotation link (131) with a planetary gear (191). When such rotation is made, a planetary gear (19) is controlled by a stopper (221) which is controlled by a bridging (26) and a resilient plate (27). Such action can prevent it from moving down by itself by small power where the jaw protection is moved up at maximum.

The present invention as stated above is to allow a jaw protection (4) installed in the lower front portion of a helmet body (1) to move up and down, thereby only the jaw protection is permitted to be rotated and moved upwardly on the state where a rider wears said helmet. Eventually, the present enables the motorcyclist to a person to freely talk with another person and to drink and smoke.

And, the present invention provide the prevention of the flow of the jaw protection by moving up and down said jaw protection, and by fixedly maintaining the fixation condition.

In addition, the rotation gravity of said jaw protection should be located at the back of a fixed pivot of a shield, the center portion of the helmet and therefore, the loading of the gravity center of said jaw protection may not bias the front side of the helmet and the transfer of the gravity center may allow the whole weight and loading of the helmet, when said helmet is worn, to be at work evenly in the head of the wearer. By doing so, a feeling of wearing the helmet can be stabilized.

What is claimed is:

1. In a jaw protecting apparatus of a helmet in which a shield is installed in a front opening part of a helmet body in such a manner that said shield moves up and down, and a jaw protecting member having an anti-shocking material is installed in a lower front portion of the shield, an improved jaw protecting apparatus of a helmet, comprising:

a fixture which includes an engaging shoulder portion and is installed at both sides of the helmet body;

a locker which is installed at both sides of the jaw protecting member;

a supporter installed in a front inner side of the jaw protecting member;

a rotation member which includes a handle and is rotatably installed in the supporter;

a band connected with the locker and having a center portion fixed to the rotation member; and a rotary link installed in an upper portion of the jaw protecting member in such a manner that as the rotation member is rotated the locker connected with the band is rotated and is locked by the fixture, whereby a weight center of the jaw protecting member is positioned in rear side of the helmet by a rotary central pivot support the rotary link and a first planetary gear supported by the rotary link.

2. The apparatus of claim 1, wherein the rotary link includes a circular elongated hole in the upper portion of the jaw protecting member, the rotary central pivot and the first planetary gear each having a protrusion are installed in the rotary link, a second planetary gear engaged with the first planetary gear is rotatably mounted to and located on an upper side of a fixed pivot, a control bolt is fixed to the helmet body at a location above the fixed pivot, a guider is fixed to a jaw protection assembly at a location above the fixed pivot, and a stopper is fixed to the jaw protection assembly at a location below the fixed pivot wherein the control bolt is inserted into the elongated hole of the rotary link, and the rotary central pivot is inserted into the guider.

3. The apparatus of ciaim 1, wherein a guide is installed at one side of the fixture, a locker elastically supported by a spring is installed in the guide and is slidable in an elongated hole, a wire is fixedly connected with a rotation part or actuator in a state that an end of the wire guided by a wire guide is fixed to an inner end of the jaw protecting member, the other end of the wire is fixed to the locker for thereby locking and unlocking the protecting member by pulling-up and releasing the rotation part or actuator, a rotary link having a first planetary gear is installed in the rear side of the jaw protecting member, and a second gear is engaged with the first planetary gear, so that the jaw protecting member is rotated and upwardly moved whereby the rotary central pivot is backwardly moved for thereby moving the weight center of the helmet in a backward direction.

4. In a helmet wherein a shield is installed at a front opening of a helmet body so that the shield is movable alternately up and down, an improved jaw protecting apparatus comprising:

a jaw protecting member having an anti-shocking or shock-absorbing material, said jaw protecting member being mounted to a lower front portion of the shield, a pair of fixtures installed on opposing lateral sides of the helmet body, each of said fixtures including an engaging shoulder portion;

a pair of lockers or locking elements mounted on opposing lateral sides of said jaw protecting member, said lockers or locking elements being engageable with respective ones of said shoulder portions to lock said jaw protecting member and the shield to the helmet body;

a support coupled to a front inner side of said jaw protecting member;

a rotation member which includes a handle and is rotatably mounted to said support;

at least one tensile force transmitting element connected to said rotation member and at least one of said lockers or locking elements to induce a shifting of said one of said lockers or locking elements relative to the respective one of said shoulder portions and a concomitant unlatching of said jaw protecting element and the shield from said helmet body; and a rotary link rotatably connecting an upper portion of said jaw protecting member to the helmet body to enable a pivoting of the shield and said jaw protecting member between an opened position and a closed position in which said lockers or locking elements are lockingly engaged with said shoulder portions of said fixtures.

5. The apparatus of claim 4 wherein said lockers or locking elements are pivotably mounted to said jaw protecting member.

6. The apparatus of claim 5 wherein said tensile force transmitting element is a band connected at opposite ends to said lockers or locking elements and having a center portion fixed to said rotation member.

7. The apparatus of claim 4 wherein said lockers or locking elements are slidably mounted to said jaw protecting member.

8. The apparatus of claim 7 wherein said tensile force transmitting element is a wire connected to said one of said lockers or locking elements and to said rotation member.

9. The apparatus of claim 7 wherein said lockers or locking elements are slidably mounted in slots of respective guides on the jaw protecting member, said lockers or locking elements being spring loaded.

10. The apparatus of claim 4 wherein said rotary link includes:

a rotary central pivot;

a first planetary gear fixed to said rotary central pivot for positioning a weight center of said jaw protecting member at rear side of the helmet;

a rotary link plate provided with an elongated arcuate hole and disposed in an upper portion of the jaw protecting member, said rotary central pivot and said first planetary gear each having a protrusion and each being connected to said rotary link plate;

a fixed pivot secured to the helmet body;

a second planetary gear engaged with the first planetary gear and formed on an upper portion of said fixed pivot;

a control bolt fixed to said helmet body at a location above said fixed pivot, said control bolt being inserted through said elongated arcuate hole;

a guider fixed to a jaw protection assembly at a location above said fixed pivot, said rotary central pivot being inserted into said guider; and a stopper fixed to said jaw protection at a location below said fixed pivot.

* * * * *